US005956803A

United States Patent [19]

Monesson

[11] Patent Number: 5,956,803

[45] Date of Patent: Sep. 28, 1999

[54] ADAPTOR FOR A CANISTER-TYPE VACUUM CLEANER

[76] Inventor: Joel Monesson, 45 Burlington Dr., Brick, N.J. 08723

[21] Appl. No.: 08/892,303

[22] Filed: Jul. 14, 1997

[51] Int. Cl.[6] ..... A47L 5/00

[52] U.S. Cl. ..... 15/327.2; 15/347; 15/352

[58] Field of Search ..... 15/327.2, 347, 15/352; 55/369, 373, 374

[56] References Cited

U.S. PATENT DOCUMENTS

| | | | |
|---|---|---|---|
| 3,616,622 | 11/1971 | Friedman | 15/327.1 |
| 4,380,845 | 4/1983 | Miller et al. | 15/344 |
| 4,739,535 | 4/1988 | Schuld | 15/315 |
| 4,995,137 | 2/1991 | Reichborn | 15/327.1 |
| 5,564,155 | 10/1996 | Monesson | 15/246.2 |

*Primary Examiner*—David A. Redding
*Attorney, Agent, or Firm*—Clifford G. Frayne

[57] ABSTRACT

An adaptor for a canister type vacuum cleaner incorporating a bin, a vacuum blower having an inlet leading into the interior of the bin and an outlet leading to the atmosphere, this particular type of canister type vacuum cleaner having a side inlet flush with the inner side wall of the bin, the adaptor for permitting the positioning of a disposal bag within the bin, the adaptor being of two piece construction, including a base associated with or secured about the inlet, the base having a throughbore aligned with the inlet, the throughbore being frictionally engaged by a sleeve extending inwardly therefrom, the sleeve inserted into the throughbore with a portion of the disposal bag so as to secure the disposal bag over the inlet, a slit being made in the disposal bag at the inlet.

9 Claims, 6 Drawing Sheets

ADAPTOR FOR A CANISTER-TYPE VACUUM CLEANER

BACKGROUND OF THE INVENTION

1. Field of Invention

This invention relates to canister-type vacuum cleaners and more particularly, to those used in commercial and/or industrial locations to collect such debris as dust, dirt, noxious substances and other dry materials.

2. Description of the Prior Art

As is known and understood, many different makes of canister-type vacuum cleaners are available for commercial or industrial use as compared to the typical vacuum cleaner design used residentially. Sold under such names as Black & Decker, Shop Vac, Wet-Dry Vac, Eureka, Hoover and Sears, these types of machines all include a cylindrical bin having a vacuum blower connected at its upper end and a pick up hose coupled to either its top or through its side. As contrasted with the "residential" type vacuum cleaner, noted to be absent is any type of disposable collection bag. Thus once the cylindrical bin is filled, it is then carried outside and dumped. Usually, with "dry" materials being collected, the result is a blowing up of a dust cloud in the user's face. To avoid this, suggestions have been made to line the bin with a plastic disposable bag before use so that the bag can be tied, once filled, removed from the bin and disposed in any available, permissible manner. Many of these attempts, however, proved unsuccessful in that the disposable plastic bag got sucked in at the filter mechanism or at the outlet to the external atmosphere. These attempts quickly proved unusable and led to further attempts to solve the problem.

Applicant presented one such solution in U.S. Pat. No. 5,564,155, wherein a coilable sleeve was fit into the bag within the canister. The coilable sleeve being of a width to unfurl to expand the bag towards the wall of the bin and of such rigidity to maintain its unfurled shape and the expansion of the bag against the suction of the vacuum blower.

Applicant's coilable sleeve solved the problem of maintaining the disposable bag in a substantially expanded mode for the collection of debris and prevented the collapse of the disposable bag as a result of the suction of the vacuum blower. Applicant's coilable sleeve proved adaptable to canister-type vacuum cleaners in which the inlet leading to the interior was on the top of the canister-type vacuum cleaner and also to canister-type vacuum cleaners in which the inlet was on the side of the canister and the inlet presented a cylindrical protrusion on the inner wall of the canister. In the latter situation, a portion of the side wall of the disposable bag was fitted over the cylindrical protrusion and removably secured thereto by an elastic band. A slit in the portion of the disposable bag which overlapped the cylindrical portion would allow the ingress of the dry material being vacuumed. Applicant's coilable sleeve was then positioned within the bag and the lid of the canister-type vacuum cleaner was secured in position for the collection of such debris and other dry materials.

One problem which has arisen with respect to the wide variety of canister-type vacuum cleaners on the market is that in some instances, the inner wall of the cylindrical bin has no cylindrical protrusion at the inlet port. In those instances, the inlet port is flush with the inner wall of the cylindrical bin allowing no means for securing a portion of the side wall of the disposable bag in position to insure that the collected debris and dry material is collected in the disposable bag.

The adaptor of the instant invention provides a solution to this problem and allows owners of canister-type vacuum cleaners to utilize a disposable bag in conjunction with applicant's coilable sleeve to collect debris and dry materials and dispose of same in an efficient manner.

OBJECTS OF THE INVENTION

It is an object of the present invention to provide for a novel adaptor within the cylindrical bin of a canister-type vacuum cleaner, proximate the inlet port so as to permit the positioning of a disposable collection bag within the cylindrical bin.

It is a still further object of the present invention to provide for a novel adaptor positioning within the bin of a canister-type vacuum cleaner and proximate the inlet port so as to permit the securing of a disposable collection bag within the bin.

It is a still further object of the present invention to provide for a novel adaptor for use in the cylindrical bin of a canister-type vacuum cleaner and position proximate the inlet port, so as to direct the incoming air and collected dry material in a cyclonic direction within the bin.

SUMMARY OF THE INVENTION

An adaptor to be affixed to the interior cylindrical wall of a canister-type vacuum cleaner, proximate the inlet port, the adaptor having a base formed to the curvature of the interior cylindrical wall of the canister-type vacuum cleaner or deformable to adapt to the curvature of the interior cylindrical wall of a canister-type vacuum cleaner, the base having an aperture therethrough, the aperture being larger than the inlet port to the cylindrical bin of the canister-type vacuum cleaner, one face of the base of the adaptor having a securing means applied thereto to position the base of the adaptor to the side wall and aligning the aperture with the inlet port and collar frictionally securable in the aperture of the base and about the inlet port. The collar providing an extension of the inlet port into the cylindrical bin so as to permit a portion of the side wall of a disposable bag to be positioned between the collar and the adaptor and secured as a result of the frictional engagement of the collar and the adaptor, thereafter a hole being cut in the portion of the disposable bag extending across the collar to permit the ingress into the disposable bag of debris and other dry material collected by the vacuum blower of the canister-type vacuum cleaner.

BRIEF DESCRIPTION OF THE DRAWINGS

These and other features of the present invention will be more clearly understood from the consideration of the following description, taken in connection with the accompanying drawings in which.

DETAILED DESCRIPTION OF THE DRAWINGS

Figure 1:
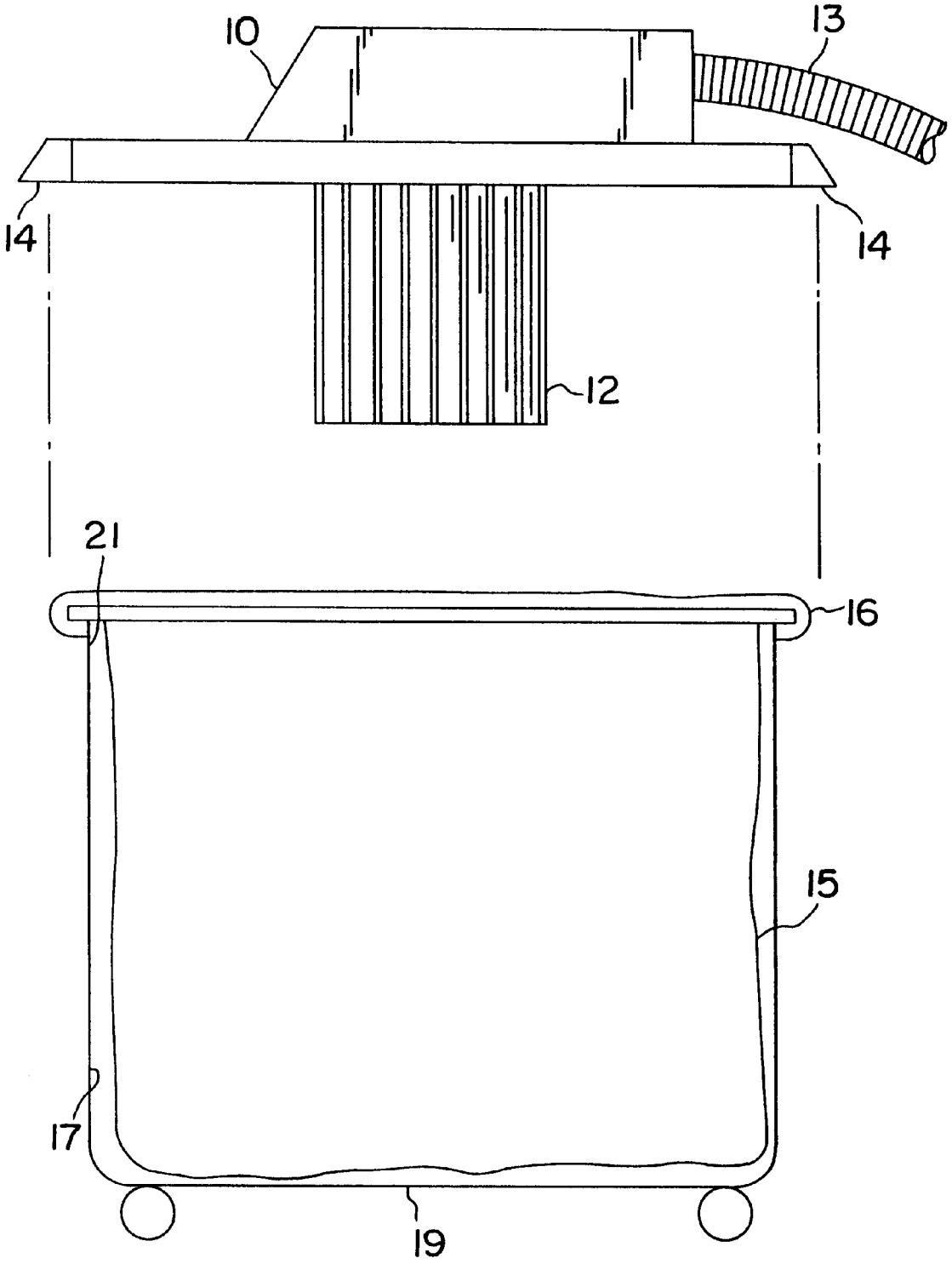
FIG. 1 PRIOR ART
FIG. 1 is a partially exploded view illustrating a canister-type vacuum cleaner construction having a top vacuum inlet for the purpose of identifying the various elements of the canister-type vacuum cleaner.

In FIG. 1 there is illustrated an exploded side view of a typical canister-type vacuum cleaner which comprises a blower motor 10, a filter 12, a hose inlet 13, which in this particular configuration is a top hose inlet. These elements are normally positioned or secured to a cover 14, which is removably snap fit to the canister.

The lower unit of the canister-type vacuum cleaner comprises a bin 15 normally having circumferential side walls 17, a bottom 19, and an open upper end 21.

In accordance with the invention as disclosed in U.S. Pat. No. 5,564,155, a disposable bag 16 would preferably be deployed within the bin 15 to accumulate the debris collected and to provide for easy disposal. However, since the suction is provided by motor 10 through filter means 12, any such bag so disposed would be sucked away from the inner side walls of bin 15 and clog the filter and motor means 12 and 10 respectively. The problem of maintaining the disposable bag in an expanded position is solved by the coilable liner 18 which is the subject matter of U.S. Pat. No. 5,564,155, which is hereby incorporated by reference.

Figure 2:
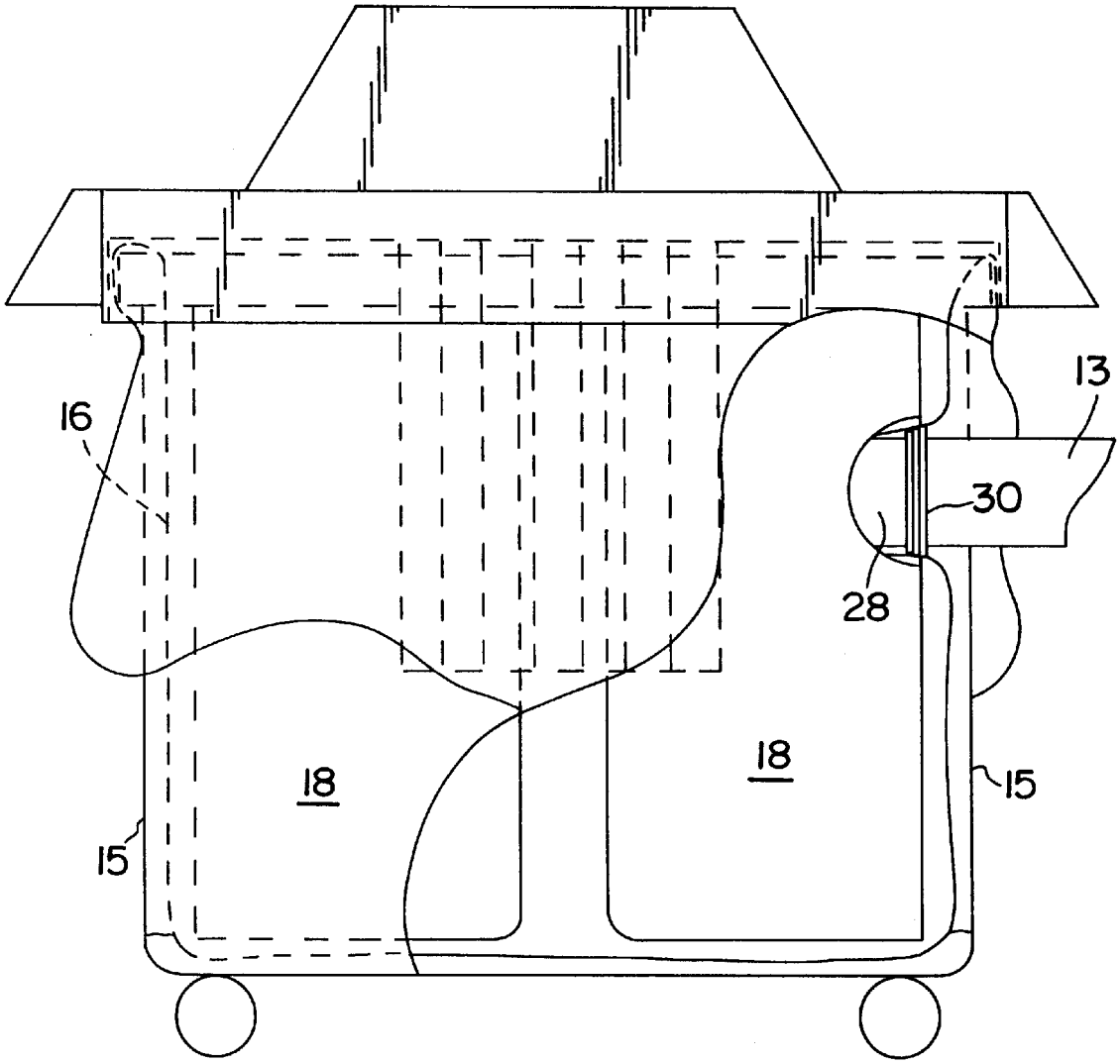
FIG. 2 PRIOR ART
FIG. 2 illustrates a canister-type vacuum cleaner construction employing a side inlet rather than a top inlet and illustrating the positioning of the coiled removable liner together with disposable bag.

FIG. 2 is illustrative of a canister-type vacuum cleaner having disposal bag 16 in place within bin 15 with the coilable liner 18 in position, only this particular canister-type vacuum cleaner illustrates a side entry for vacuum hose 13. In this configuration, the disposable bag 16 is positioned within bin 15 and the coilable liner 18 of U.S. Pat. No. 5,564,155 is positioned in order to secure the disposable bag over the protruding inlet 28 which extends into the canister area. The bag is then secured about the protrusion 28 by means of an elastic band 30 and a slit is made in the disposable bag 16 over the protrusion 28 to allow debris and dry material to be collected within the disposable bag while the disposable bag is maintained in position in cooperation with the coilable liner 18 and the elastic band 20. The problem which the instant application seeks to solve is on those canister-type vacuum cleaners in which there is a side inlet as illustrated in FIG. 2, but there is no protrusion 28 into the bin 15, but rather, the connection is flush with the inner circumferential wall 17 of bin 15.

Figure 3:
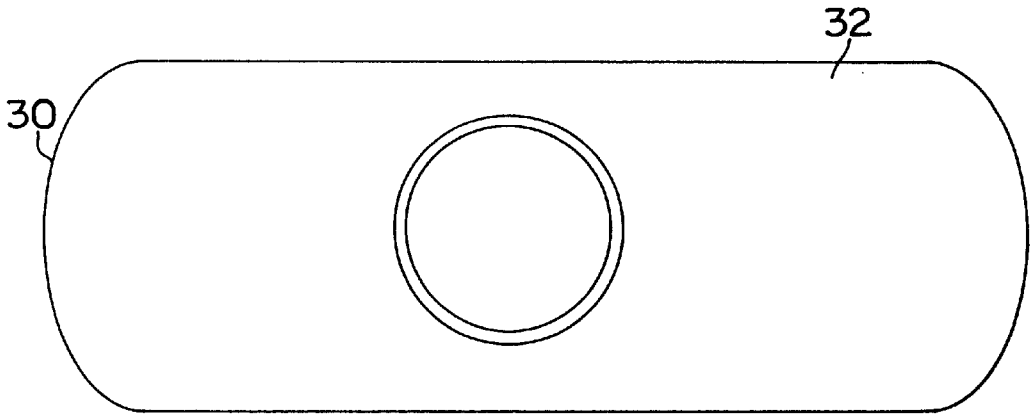
FIG. 3 illustrates a front view of the adaptor, which is the subject of the present invention.
Figure 4:
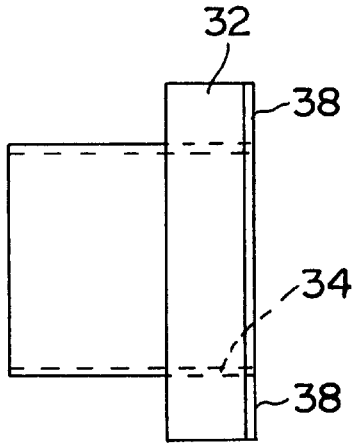
FIG. 4 illustrates a side view of the adaptor of the present invention.
Figure 5:
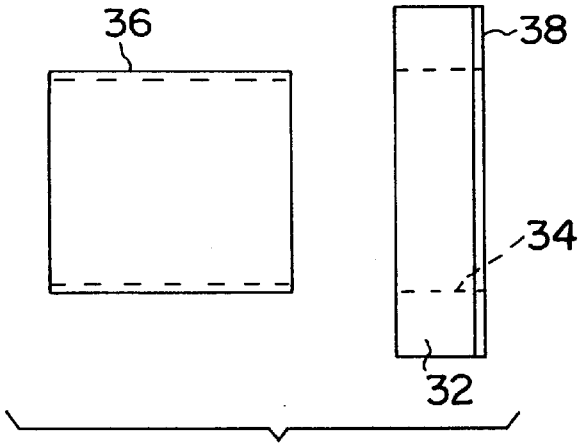
FIG. 5 illustrates an exploded side view of the adaptor.

FIG. 3 illustrates a front view of the adaptor which is the subject matter of this application, FIG. 4 illustrates a side view of the adaptor which is the subject matter of the present invention and FIG. 5 illustrates an exploded view. The adaptor 30 which is the subject matter of the present invention comprises a base 32 having a throughbore 34 positioned therethrough. The throughbore 34 is dimensioned to be slightly larger than the entry orifice in the circumferential side wall 17 of bin 15 for a side inlet canister-type vacuum cleaner. Throughbore 34 is designed to frictionally accommodate a collar member 36, which would be slidably receivable within throughbore 34 and frictionally engagable therewith. Base 32 may also have an adhesive backing 38 secured to one side thereof for attachment of the base to the cylindrical inner side wall 17 of bin 15. It will be understood that the thickness of base 32 need only be sufficient so as to insure enough surface contact with the outer wall of collar 36 in order to maintain collar 36 in position. Further, base 32 would preferably be made of a flexible material so as to adhere and conform to the cylindrical inner side wall 17 of bin 15 and thereby be adaptable to canister-type vacuum cleaners of varying diameters. FIG. 5 illustrates the base member 32 and collar 36 is a side exploded view.

Figure 6:
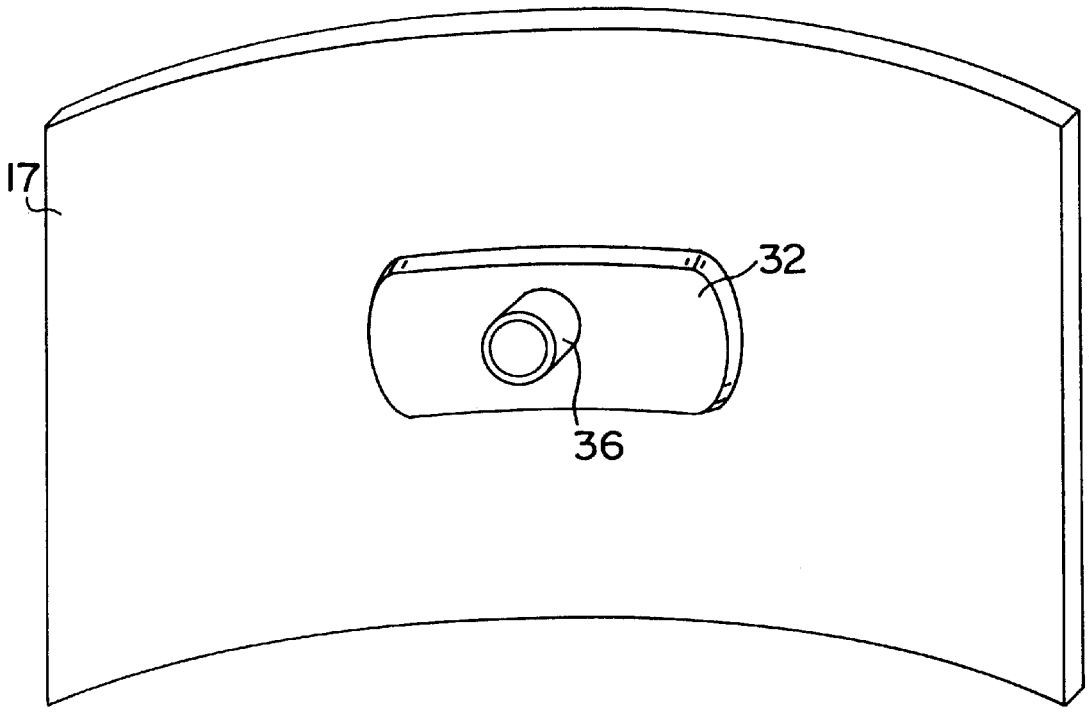
FIG. 6 illustrates a prospective, partial cut away view of the adaptor of the present invention in conjunction with the inner circumferential side wall of the canister-type vacuum cleaner.

FIG. 6 is a partial cut away view of the interior of bin 15 illustrating the positioning of adaptor 30 of the interior cylindrical wall 17 of bin 15. As illustrated in FIG. 6, the adaptor 30 is positioned in a generally horizontal configuration on inner cylindrical wall 17. It will be recognized by those skilled in the art that base 30 could be oriented in a vertical position provided it was dimensioned such that enough surface area of the adhesive face of adaptor 30 contact with inner cylindrical side wall 17 would insure its being maintained in position.

Figure 7:
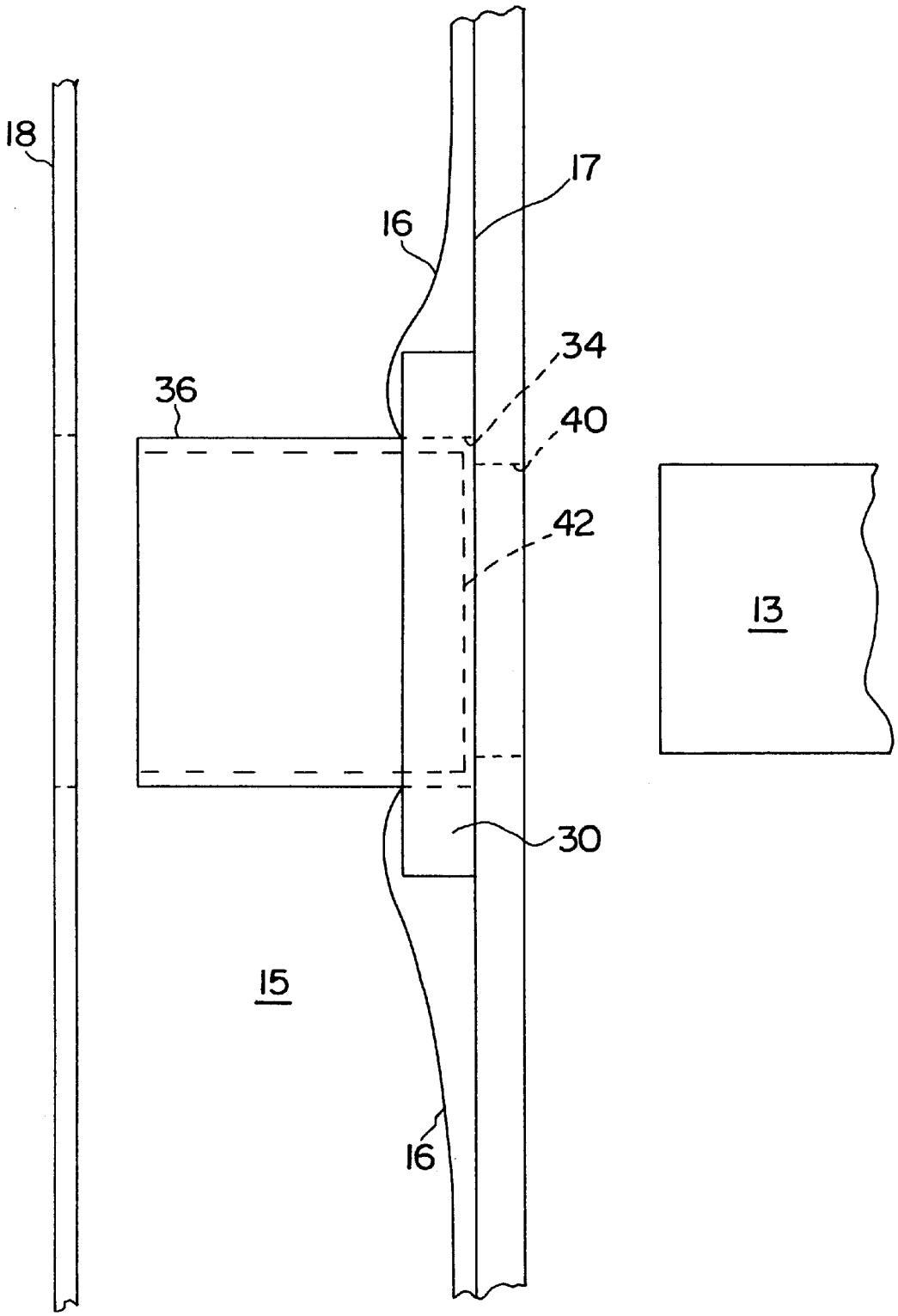
FIG. 7 is a partial side view in close up of the side inlet port with adaptor, bag and coilable liner.

FIG. 7 is a partial cut away side view of a side inlet of a canister-type vacuum cleaner illustrating applicant's adaptor in cooperation with the disposable bag and applicant's coilable liner in place. Applicant's adaptor 30 would be positioned on the inner cylindrical side wall 17 of bin 15 such that throughbore 34 surrounded inlet opening 40. Disposable bag 16 would then be disposed within bin 15. Applicant's collar 36 would be inserted into the throughbore 34 and pushed toward the surface of inner cylindrical side wall 17 about inlet 40, and simultaneously, a portion of disposable bag 16 in front of throughbore 34 would be engaged by collar 36 when inserted into throughbore 34 and would be maintained in position by the fit between collar 36 and adaptor 30. The operator would then make a cut in disposable bag 16 at 42, so as to thereby allow the passage of air and collected debris from inlet hose 13, through the wall of bin 15, and through the combination of applicant's adaptor base 32 and collar 36 and into the disposable bag 16. Coilable liner 18 would then be inserted into the disposable bag 16 within bin 15 and oriented as per the teaching of U.S. Pat. No. 5,564,155.

Upon the accumulation of debris sufficient to fill disposable bag 16, the blower 10 would be disengaged, the top 14 of the canister-type vacuum cleaner would be removed and the operator would remove collar 36 and would gather about the ends of disposable bag 16 which extended outwardly over the upper opening 21 of bin 15 and the disposable bag 16 with collected debris and coilable liner could be lifted from the bin 15 and removed to a disposal area where coilable liner 18 could be removed for reuse and the disposable bag and collected debris could be disposed.

It is important that the diameter of throughbore 34 and the inner diameter of collar 36 be sufficient so as not to contact or interfere with inlet hose 13 which is held in place by frictional engagement between its outer diameter and the diameter inlet opening in sidewall 17.

Figure 8:
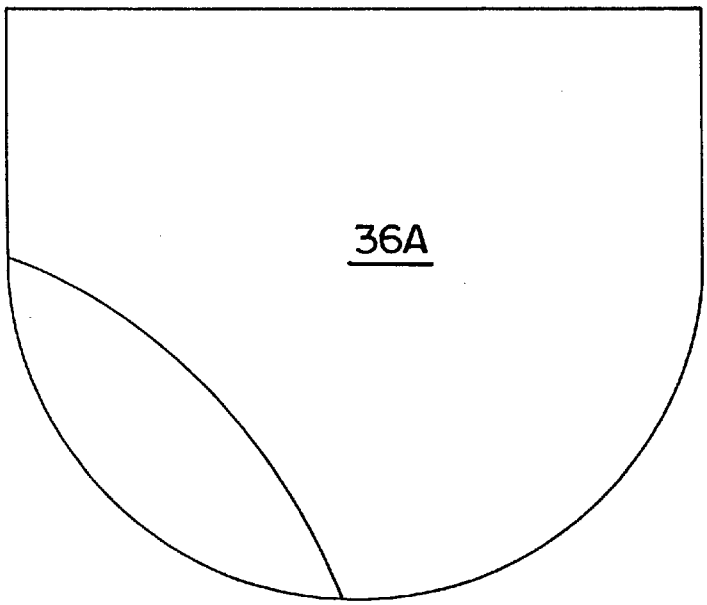
FIG. 8 is a top view of a second embodiment of the adaptor.

FIG. 8 illustrates a second embodiment of adaptor 30 and more particularly, a second embodiment of collar 36. In this embodiment, rather than collar 36 being of a cylindrical configuration having parallel circular openings, one end of collar 36A is formed as a partial elbow such that the incoming air and debris is turned approximately 90 degrees and thus creates a cyclonic flow within bin 15. This permits more efficient collection of the debris within bag 16 and redirects the air and debris around depending filter 12 as opposed to directing it directly at depending filter 12 such that it would accumulate on the filter prematurely thereby affecting filter efficiency and blower motor efficiency.

Figure 9:
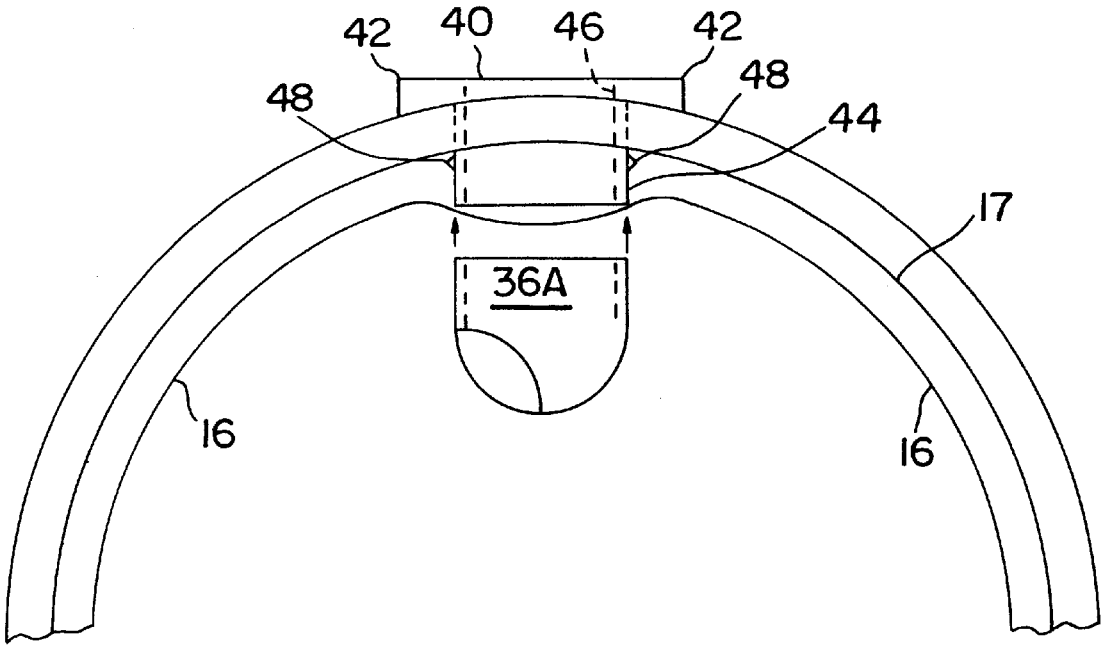
FIG. 9 is an exploded partial top view of a third embodiment of the present invention.

FIG. 9 is yet another embodiment of a structure which solves the problem of positioning a disposal bag 16 within a canister type vacuum cleaner that does not have any interior protrusion from the side wall to allow for the fastening of the disposal bag 16. In structure and configuration illustrated in FIG. 9, there is an aperture in circumferential side wall 17 but no interior protrusion. A collar 40 defined by a circumferential annular flange 42, and a circumferential skirt 44 define a throughbore 46 the diameter of which is substantially equal to the diameter of the inlet hose 13 so as to permit frictional engagement therewith. The outer diameter of the skirt 44 is substantially equal to the diameter of the aperture in side wall 17 and positioned on the outer circumference of skirt 46 are a plurality of displacable tabs 48 which will lock collar 40 in place as skirt 46 is pushed through the aperture in side wall 17 from the exterior of the canister.

The sleeve member similar to the collar member 36A of the second embodiment, is designed to frictionally fit over skirt 44 such that the inner diameter of collar member 36A is substantially equal to the outer diameter of the skirt 44.

Again, in this manner, a disposable bag 16 would be disposed within the canister, and the collar member 36A would snap fit over skirt 44 trapping a portion of bag 16 between the inner circumferential diameter of collar 36A and the outer circumference of skirt 44. A slit could then be made in disposal bag 16 in the area of throughbore 46 to permit the ingress of dirt and debris. Collar 36A would again be dimensioned so as to not interfere with inlet hose 13 when frictionally secured to annular flange 42.

The collection steps and removal steps with respect to disposal bag 16 in association with this embodiment and coilable liner 18 would be identicle as with respect to the first embodiment and second embodiment disclosed herein.

While the present invention has been described with respect to the exemplary embodiments thereof, it will be recognized by those of ordinary skill in the art that certain modifications can be made without departing from the scope and teachings herein and therefore, as manifestly intended that the present invention be limited only by the claims and the equivalence thereof.

I claim:

1. An apparatus for adapting a canister vacuum cleaner having a bin, a vacuum blower, an outlet to the atmosphere, and side inlet, flush with the inner side wall of said bin, for the acceptance and receipt of a disposable bag for the collection of debris by said canister vacuum cleaner, said apparatus comprising:

a base member having a first side and a second side, said base member being flexible to conform to the inner side wall of said bin, said base member having a throughbore therethrough, said throughbore being of a diameter greater than the diameter of said inlet, said base member affixed to the inner side wall of said bin with said throughbore in alignment with said inlet;

a sleeve member cooperable with said base, said sleeve member having a first end and a second end, said first end frictionally engagable in said throughbore of said base member, said inner diameter of said sleeve member greater than the diameter of said inlet;

a disposable bag member positioned in said bin, a portion of said disposal bag positioned between said base member and said sleeve member, said sleeve member engaging a portion of said disposal bag and frictionally engaging and positioning same in said throughbore;

a slit or cut introduced into a portion of said disposal bag positioned over said inlet to permit the ingress of dirt and debris.

2. The apparatus in accordance with claim 1 wherein one side of said base member has adhesive affixed thereto for securing said adaptor to said inner wall of said bin of said canister type vacuum cleaner.

3. The apparatus in accordance with claim 1 wherein said sleeve has an elbow shaped exit oriface for directing said collected debris concentrically about said inner side wall of said bin.

4. The apparatus in accordance with claim 1 wherein the said flexible base member is comprised of a foam-like material.

5. The apparatus in accordance with claim 1 wherein the thickness of said flexible base member between said first side and said second side is of a dimension sufficient to insure that said sleeve and said disposal bag are sufficiently secured in said throughbore so as to prevent dislodgment during operation.

6. A method for adapting a canister vacuum cleaner to receive a disposal bag said canister vacuum cleaner incorporating a bin, a vacuum blower and an inlet leading into the interior of the bin and an outlet leading to the atmosphere wherein said inlet leading to the interior of said bin is positioned in the side wall of said bin and is flush with the inner side wall surface, said method comprising:

positioning a flexible base member having a first side and a second side on said inner side wall of said bin, said base member having a throughbore therethrough having a diameter greater than the diameter of said inlet, said throughbore positioned about said inlet;

positioning a disposal bag within said bin of said canister type vacuum cleaner;

inserting a sleeve member having an inner diameter greater than the diameter of said inlet, into said throughbore of said base member so as to frictionally secure a portion of the side wall of said disposal bag over said inlet;

cutting a said portion of said disposal bag positioned over said inlet to permit the ingress of dirt and debris.

7. An apparatus used in combination with a canister vacuum cleaner for positioning and securing a disposal bag within said canister vacuum cleaner for the collection of dirt and debris, said adaptor comprising:

a canister vacuum cleaner having a bin, a vacuum blower, an outlet to the atmosphere, and a side inlet, said side inlet being flush with the inner side wall of said bin;

a collar member having a first end or a second end, said first end comprising an annular ring portion having a diameter greater than the diameter of the inlet to said canister type vacuum cleaner, said annular ring member having a skirt depending from one side thereof, there being a throughbore defined between said annular ring member and said skirt, said skirt having an outer diameter equal to the diameter of said inlet, said skirt having positioned thereon, a plurality of deformable tabs such when said skirt is introduced into said inlet, said collar will snap fit into position with said side wall of said bin positioned between said deformable tabs and said annular ring;

a sleeve frictionally securable on said skirt, on said interior of said bin, said sleeve designed to position a portion of the side wall of said disposal bag between said sleeve and said skirt when so secured, a slit or cut introduced into the portion of said disposal bag over said inlet to permit the ingress of dirt and debris.

8. The adaptor in accordance with claim 7 wherein said sleeve has an elbow shaped exit orifice for directing the collected debris concentrically about said inner side wall of said bin.

9. The adaptor in accordance with claim 7 wherein said adaptor is constructed of molded plastic.

* * * * *